US011236640B2

(12) United States Patent
Tamura

(10) Patent No.: US 11,236,640 B2
(45) Date of Patent: Feb. 1, 2022

(54) STEAM POWER PLANT, MODIFICATION METHOD AND OPERATION METHOD OF STEAM POWER PLANT

(71) Applicant: Mitsubishi Power, Ltd., Yokohama (JP)

(72) Inventor: Shingo Tamura, Yokohama (JP)

(73) Assignee: Mitsubishi Power, Ltd., Yokohama (JP)

( * ) Notice: Subject to any disclaimer, the term of this patent is extended or adjusted under 35 U.S.C. 154(b) by 0 days.

(21) Appl. No.: 16/929,937

(22) Filed: Jul. 15, 2020

(65) Prior Publication Data

US 2021/0017882 A1 Jan. 21, 2021

(30) Foreign Application Priority Data

Jul. 16, 2019 (JP) ..... JP2019-130852

(51) Int. Cl.
*F01K 7/22* (2006.01)
*F01K 7/40* (2006.01)
(Continued)

(52) U.S. Cl.
CPC ..... *F01K 7/22* (2013.01); *F01K 7/24* (2013.01); *F01K 7/26* (2013.01); *F01K 7/34* (2013.01);
(Continued)

(58) Field of Classification Search
CPC . F22D 1/003; F22D 1/32; F22D 1/325; F01K 7/22; F01K 7/226; F01K 7/24;
(Continued)

(56) References Cited

U.S. PATENT DOCUMENTS 2,955,429 A * 10/1960 Miller ..... F01K 7/22 60/679
3,894,394 A * 7/1975 Braytenbah ..... F01D 19/02 376/211
(Continued)

FOREIGN PATENT DOCUMENTS

CN 107246286 A 10/2017
CN 109653810 A * 4/2019
(Continued)

OTHER PUBLICATIONS

Korean-language Office Action issued in Korean Application No. 10-2020-0084691 dated May 25, 2021 with English translation (18 pages).
(Continued)

*Primary Examiner* — Mark A Laurenzi
*Assistant Examiner* — Mickey H France
(74) *Attorney, Agent, or Firm* — Crowell & Moring LLP

(57) ABSTRACT

A steam power plant includes a first steam power plant, a second steam power plant, and an inter-unit. The first steam power plant includes a boiler, a high-pressure turbine, a first reheat line, a first feed water heater, and a high-pressure extraction steam line. The second steam power plant includes a boiler, a high-pressure turbine, a first reheat line, a first feed water heater, and a high-pressure extraction steam line. The inter-unit connected extraction steam line connects the high-pressure extraction steam line of the first steam power plant with the high-pressure extraction steam line of the second steam power plant.

8 Claims, 3 Drawing Sheets

(51) Int. Cl.

| | |
|---|---|
| ***F22D 1/00*** | (2006.01) |
| ***F01K 7/26*** | (2006.01) |
| ***F01K 11/02*** | (2006.01) |
| ***F01K 13/02*** | (2006.01) |
| ***F01K 7/38*** | (2006.01) |
| ***F01K 7/24*** | (2006.01) |
| ***F01K 7/34*** | (2006.01) |
| ***F22D 1/32*** | (2006.01) |
| ***F01K 17/00*** | (2006.01) |

(52) U.S. Cl.
CPC ..... *F01K 7/345* (2013.01); *F01K 7/38* (2013.01); *F01K 7/40* (2013.01); *F01K 11/02* (2013.01); *F01K 13/02* (2013.01); *F01K 17/00* (2013.01); *F22D 1/003* (2013.01); *F22D 1/325* (2013.01)

(58) Field of Classification Search
CPC ..... F01K 7/26; F01K 7/28; F01K 7/34; F01K 7/345; F01K 7/38; F01K 7/40; F01K 17/00; F01K 13/02
USPC ..... 60/645, 648, 652, 654, 662, 665, 667, 60/676, 677, 678
See application file for complete search history.

(56) References Cited

U.S. PATENT DOCUMENTS

| | | | | | |
|---|---|---|---|---|---|
| 4,007,596 | A * | 2/1977 | Braytenbah | F01K 3/181 | 376/211 |
| 4,316,362 | A | 2/1982 | Ninomiya et al. | | |
| 2011/0005225 | A1* | 1/2011 | Namba | F01K 17/005 | 60/645 |
| 2012/0096865 | A1* | 4/2012 | Murakami | F01K 17/06 | 60/676 |
| 2012/0255309 | A1* | 10/2012 | Venetos | F22B 1/006 | 60/772 |
| 2014/0208749 | A1* | 7/2014 | Murakami | B01D 53/1425 | 60/645 |

FOREIGN PATENT DOCUMENTS

| | | | | | |
|---|---|---|---|---|---|
| GB | 835245 | A | * | 5/1960 | F01K 19/02 |
| JP | 8-177409 | A | | 7/1996 | |
| JP | 2001-182903 | A | | 7/2001 | |
| JP | 2006-46087 | A | | 2/2006 | |
| JP | 2007-239685 | A | | 9/2007 | |
| KR | 10-2004-0055256 | A | | 6/2004 | |
| RU | 1802177 | A1 | * | 3/1993 | |
| RU | 2691881 | C1 | * | 6/2019 | |
| SU | 775357 | B | * | 10/1980 | |

OTHER PUBLICATIONS

Australian Examination Report issued in Australian Application No. 2020204587 dated Jul. 8, 2021 (five (5) pages).

Shröder, K., Große Dampfkraftwerke [large steam power plants]. Power plant atlas with specific values of 200 power plants 98 descriptions of power plants and 6 exemplary embodiments. Berlin Heidelberg : Springer-Verlag, 1959, pp. 690-703.—ISBN 978-3-540-02395-1. (14 pages) (https://rd.springer.com/book/10.1007/978-3-642-52090-7) [retrieved on Sep. 21, 2021].

German Office Action issued in German Application No. 10 2020 208 912.4 dated Sep. 21, 2021 with English translation (19 pages).

* cited by examiner

STEAM POWER PLANT, MODIFICATION METHOD AND OPERATION METHOD OF STEAM POWER PLANT

CLAIM OF PRIORITY

The present application claims priority from Japanese Patent application serial no. 2019-130852, filed on Jul. 16, 2019, the content of which is hereby incorporated by reference into this application.

BACKGROUND OF THE INVENTION

The present invention relates to a steam power plant which has a plurality of units (steam power plants), a modification method of the steam power plant, and an operation method of the steam power plant.

Opportunities that partial-load operation of the steam power plant is performed are increasing in association with an increase in amount of renewable energies. However, in the steam power plant, turbine power efficiency (in the following, a description will be made by calling it the plant efficiency) is reduced in the partial-load operation. Accordingly, a steam power plant whose plant efficiency is not reduced even in the partial-load operation is requested. Japanese Unexamined Patent Application Publication No. Hei 8-177409 is proposed as a background technology in this technical field.

A steam turbine plant (a steam power plant) which has a plurality of low-pressure turbines for improvement of the plant efficiency in the partial-load operation which copes with power demand is described in Japanese Unexamined Patent Application Publication No. Hei 8-177409. Then, a steam turbine plant in which a control valve for speed control is installed in an inlet of one low-pressure turbine and a generator which is driven by one low-pressure turbine and another/other low-pressure turbine(s) is installed and which has a separation mechanism which separates one low-pressure turbine from the generator is also described in Japanese Unexamined Patent Application Publication No. Hei 8-177409 (see Abstract).

SUMMARY OF THE INVENTION

The steam power plant which is described in Japanese Unexamined Patent Application Publication No. Hei 8-177409 is configured by one unit and a steam power plant which has a plurality of units is not described in Japanese Unexamined Patent Application Publication No. Hei 8-177409.

Accordingly, the present invention provides a steam power plant which has the plurality of units and improves the plant efficiency in the partial-load operation of the plurality of units (the steam power plants) in total, a modification method of the steam power plant, and an operation method of the steam power plant.

In order to solve the abovementioned problem, according to one embodiment of the present invention, there is provided a steam power plant which includes a first steam power plant (a first unit) having a boiler which generates steam, a high-pressure turbine which is driven with the steam that the boiler generates, a first reheat line which supplies the steam which is exhausted or extracted from the high-pressure turbine to the boiler, a first feed water heater to which part of the steam which is exhausted or extracted from the high-pressure turbine is supplied, and a high-pressure extraction steam line which supplies the part of the steam which is exhausted or extracted from the high-pressure turbine to the first feed water heater, and a second steam power plant (a second unit) having a boiler which generates steam, a high-pressure turbine which is driven with the steam that the boiler generates, a first reheat line which supplies the steam which is exhausted or extracted from the high-pressure turbine to the boiler, a first feed water heater to which part of the steam which is exhausted or extracted from the high-pressure turbine is supplied, and a high-pressure extraction steam line which supplies the part of the steam which is exhausted or extracted from the high-pressure turbine to the first feed water heater, and an inter-unit connected extraction steam line which connects the high-pressure extraction steam line of the first steam power plant with the high-pressure extraction steam line of the second steam power plant.

According to one embodiment of the present invention, there is also provided a modification method of a steam power plant having a first steam power plant (a first unit) and a second steam power plant (a second unit), including the step of installing an inter-unit connected extraction steam line which connects a high-pressure extraction steam line of the first steam power plant with a high-pressure extraction steam line of the second steam power plant in a case of modifying the steam power plant.

According to one embodiment of the present invention, there is also provided an operation method of a steam power plant having a first steam power plant (a first unit) and a second steam power plant (a second unit), including the step of supplying part of steam from a high-pressure extraction steam line of the first steam power plant to a high-pressure extraction steam line of the second steam power plant in a case of operating the first steam power plant under a high load and operating the second steam power plant under a low load.

According to the present invention, it is possible to provide the steam power plant which has the plurality of units and improves the plant efficiency in the partial-load operation of the plurality of units (steam power plants) in total, the modification method of the steam power plant, and the operation method of the steam power plant.

Incidentally, problems, configurations and effects other than the above will become apparent from the following description of one embodiment.

DETAILED DESCRIPTION OF THE PREFERRED EMBODIMENTS

In the following, one embodiment of the present invention will be described with reference to the appended drawings. Incidentally, the same numerals are assigned to the constitutional elements having the same or similar configurations and duplicated description thereof is omitted.

EMBODIMENT

First, a schematic configuration of a steam power plant which has a plurality of units according to the present embodiment of the present invention will be described.

Figure 1:
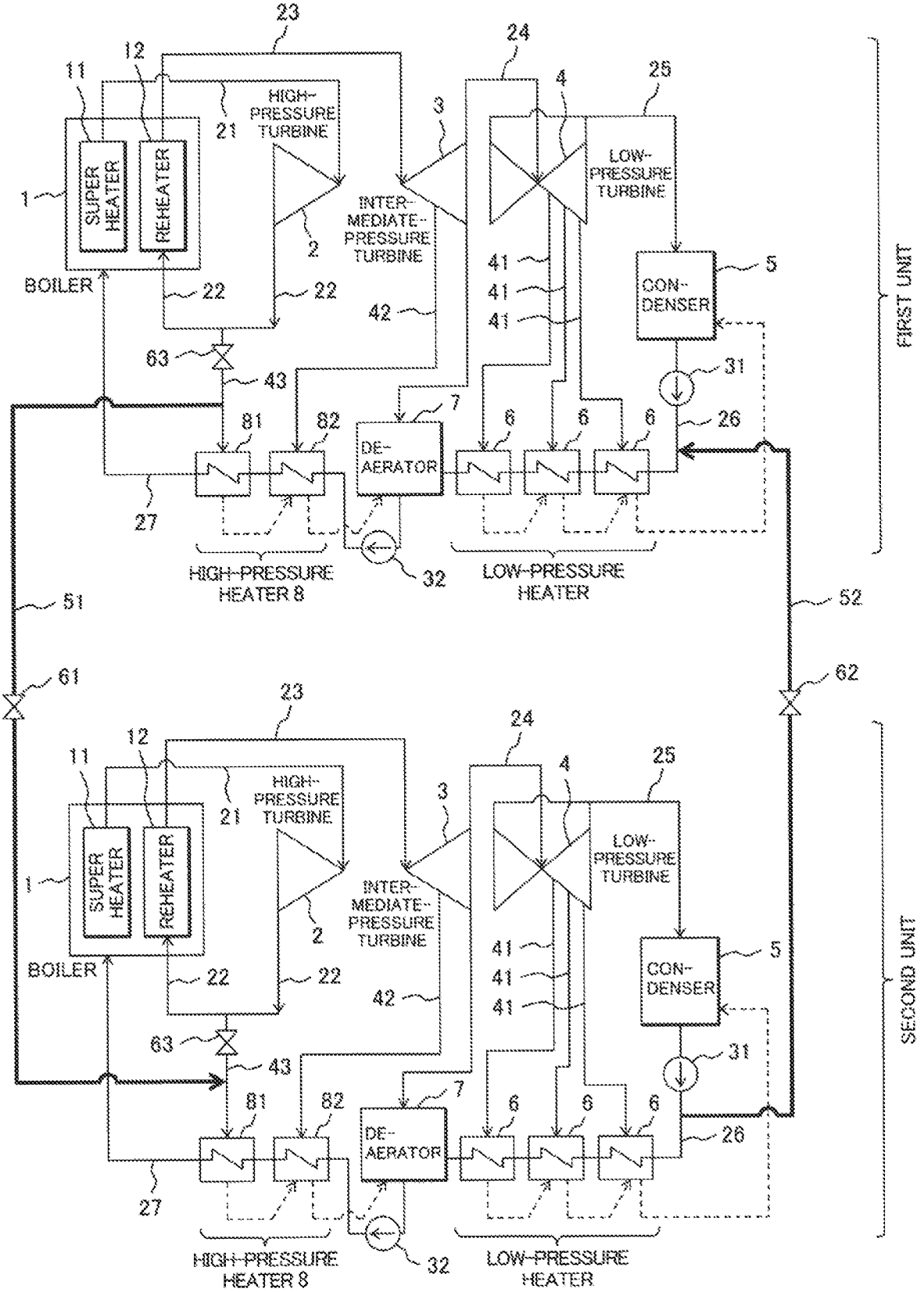
FIG. 1 is an explanatory diagram illustrating one example of a schematic configuration of a steam power plant which has a plurality of units according to one embodiment of the present invention.

FIG. 1 is an explanatory diagram illustrating one example of the schematic configuration of the steam power plant which has the plurality of units according to the present embodiment.

The steam power plant according to the present embodiment has a boiler 1 which generates steam, a high-pressure steam turbine (high-pressure turbine) 2 which is driven with the steam that the boiler 1 generates, an intermediate-pressure steam turbine (intermediate-pressure turbine) 3, a low-pressure steam turbine (low-pressure turbine) 4, a condenser 5 which condenses the steam to condensed water, and a deaerator 7 which de-aerates the condensed water (removes dissolved gas (for example, oxygen) from the condensed water) to be used as feed water.

Incidentally, the steam which is exhausted from the intermediate-pressure turbine 3 is supplied to the deaerator 7. The steam is de-aerated to be used as the feed water.

The boiler 1 has a super heater 11 which generates the steam from the feed water and a reheater 12 which reheats the steam which is exhausted from the high-pressure turbine 2.

In addition, the steam power plant according to the present embodiment has a main steam line 21 which supplies the steam which is generated in the super heater 11 of the boiler 1 to the high-pressure turbine 2, a cold reheat line (in the following, called a first reheat line 22 for the convenience of description) which supplies the steam which is exhausted from the high-pressure turbine 2 to the reheater 12 of the boiler 1, a hot reheat line 23 (in the following, called a second reheat line 23 for the convenience of description) which supplies the steam which is reheated in the repeater 12 of the boiler 1 to the intermediate-pressure turbine 3, a crossover pipe 24 which supplies the steam which is exhausted from the intermediate-pressure turbine 3 to the low-pressure turbine 4, a low-pressure steam line 25 (a case where the condenser 5 is installed directly under the low-pressure turbine 4 is included) which supplies the steam which is exhausted from the low-pressure turbine 4 to the condenser 5, a condensate system 26 which supplies the condensed water which is discharged from the condenser 5 to the deaerator 7, and a feedwater system 27 which supplies the feedwater which is discharged from the deaerator 7 to the super heater 11 of the boiler 1.

A condensate extraction pump 31 is installed on the condensate system 26, and a boiler feed pump 32 is installed on the feedwater system 27.

In addition, a plurality (three in the present embodiment) of low-pressure heaters 6 are installed on the condensate system 26, and a plurality (two in the present embodiment) of high-pressure heaters 8 are installed on the feedwater system 27. Incidentally, in the following, a description will be made by calling the downstream-side high-pressure heater 8 a first feedwater heater 81 and calling the upstream-side high-pressure heater 8 a second feedwater heater 82 for the convenience of explanation.

That is, part of the steam which is exhausted from the high-pressure turbine 2 is supplied to the first feedwater heater 81. Incidentally, the steam power plant may also be configured so as to supply the steam which is extracted from a middle stage of the high-pressure turbine 2 to the first feedwater heater 81.

In addition, the steam power plant according to the present embodiment has a plurality (three in the present embodiment) of low-pressure extraction steam lines 41 which supply the steam from the low-pressure turbine 4 to the plurality of low-pressure heaters 6 in order to use part of the steam which is exhausted from the low-pressure turbine 4 as heating steam of the plurality of low-pressure heaters 6, has an intermediate-pressure extraction steam line 42 which supplies the steam from the intermediate-pressure turbine 3 to the second feedwater heater 82 in order to use part of the steam which is exhausted from the intermediate-pressure turbine 3 as heating steam of the second feedwater heater 82 and has a high-pressure extraction steam line 43 which supplies the steam from the high-pressure turbine 2 to the first feedwater heater 81 in order to use part (extraction steam) of the steam which is exhausted from the high-pressure turbine 2 as heating steam of the first feedwater heater 81.

Incidentally, low-pressure extraction steam which is supplied from the low-pressure turbine 4 to the low-pressure heaters 6 via the low-pressure extraction steam lines 41 is subjected to heat exchange with the condensed water and becomes drainage.

In the present embodiment, the three low-pressure heaters 6 (an upper-stage low-pressure heater, a middle-stage low-pressure heater, and a lower-stage low-pressure heater are arranged in a condensed water flowing direction) are installed. Low-pressure extraction steam which is supplied to the lower-stage low-pressure heater 6 is subjected to heat exchange by the lower-stage low-pressure heater 6, becomes drainage, and is supplied to the middle-stage low-pressure heater 6. Low-pressure extraction steam which is supplied to the middle-stage low-pressure heater 6 is subjected to heat exchange by the middle-stage low-pressure heater 6, becomes drainage, and is supplied to the upper-stage low-pressure heater 6. Low-pressure extraction steam which is supplied to the upper-stage low-pressure heater 6 is subjected to heat exchange by the upper-stage low-pressure heater 6, becomes drainage, and is supplied to the condenser 5.

In addition, intermediate-pressure extraction steam which is supplied from the intermediate-pressure turbine 3 to the second feed water heater 82 via the intermediate-pressure extraction steam line 42 is subjected to heat exchange with feed water and is supplied to the deaerator 7.

In addition, high-pressure extraction steam which is supplied from the high-pressure turbine 2 to the first feed water heater 81 via the high-pressure extraction steam line 43 is subjected to heat exchange with the feed water and is supplied to the second feed water heater 82.

Incidentally, the high-pressure extraction steam line 43 is branched from the first reheat line 22. Incidentally, the high-pressure extraction steam line 43 may also be configured to supply the steam which is extracted from the middle stage of the high-pressure turbine 2 to the first feedwater heater 81.

In addition, in the steam power plant which is illustrated in FIG. 1, illustration of a generator is omitted. There are a case where one generator is installed coaxially with the high-pressure turbine 2, the intermediate-pressure turbine 3 and the low-pressure turbine 4, a case where one generator is installed coaxially with the high-pressure turbine 2 and one generator is installed coaxially with the intermediate-pressure turbine 3 and the low-pressure turbine 4, and a case where one generator is installed coaxially with the high-pressure turbine 2 and the low-pressure turbine 4 and one generator is installed coaxially with the intermediate-pressure turbine 3 and so forth.

In the present embodiment, the steam power plant which is configured in this way is defined as one unit.

That is, the steam power plant according to the present embodiment is of the type having a plurality (two in the present embodiment) of units, for example, having a first steam power plant (for example, a first unit which is illustrated on an upper stage in FIG. 1) and a second steam power plant (for example, a second unit which is illustrated on a lower stage in FIG. 1).

Incidentally, although the steam power plant which has the two units is described in the present embodiment, the number of units to be installed is not limited to two.

Then, in the present embodiment, an inter-unit connected extraction steam line (piping) 51 which connects the high-pressure extraction steam line 43 of the first steam power plant (the first unit) with the high-pressure extraction steam line 43 of the second steam power plant (the second unit) is installed.

In addition, in the present embodiment, an inter-unit connected condensate system (piping) 52 which connects the condensate system 26 of the first steam power plant (the first unit) with the condensate system 26 of the second steam power plant (the second unit) is installed.

Incidentally, although the inter-unit connected condensate system 52 is installed in the present embodiment, the system to be installed is not limited to the inter-unit connected condensate system 52 and, for example, an inter-unit connected feedwater system which connects the feedwater system 27 on the outlet side of the boiler feed pump 32 of the first unit with the feedwater system 27 on the outlet side of the boiler feed pump 32 of the second unit may be installed.

That is, the steam (extraction steam) which is part of the steam which is exhausted from the high-pressure turbine 2 and part of the steam which is supplied from the high-pressure turbine 2 to the first feedwater heater 81 and is extracted from the high-pressure extraction steam line 43 is supplied from the first unit (for example, a high-load unit: a unit which is operated under a predetermined load) to the second unit (for example, a low-load unit: a unit which is operated under a load which is lower than the predetermined load) via the inter-unit connected extraction steam line 51.

Incidentally, a high-load state is not necessarily limited to a full-load (rated-load) state and may be a partial-load state.

Incidentally, in the present embodiment, although the steam power plant has the two units and connects the first unit with the second unit, the steam power plant may have three or more units and may connect one unit with the plurality of other units. For example, the extraction steam may be supplied from one unit (the high-load unit) to the plurality of other units (the low-load units).

In addition, part of condensed water which is discharged from the condenser 5 (for example, the condensed water which corresponds to the extraction steam which is supplied from the high-load unit to the low-load unit) is supplied from the second unit (for example, the low-load unit) to the first unit (for example, the high-load unit) via the inter-unit connected condensate system 52.

Incidentally, although the condensed water which corresponds to the extraction steam which is supplied from the high-load unit to the low-load unit is returned from the low-load unit to the high-load unit in the present embodiment, an object to be returned is not limited to the condensed water. In addition, in a case where an overall flow rate of the steam in the high-load unit is ensured, that is, in a case where there is a sufficient margin in the flow rate of the steam which is used in the whole high-load unit, a return line may not be installed.

In addition, an inter-unit connected extraction steam valve 61 which is an on/off valve which controls (is opened/closed so as to control) a flow rate of the extraction steam is disposed in the inter-unit connected extraction steam line 51, and an inter-unit connected condensate valve 62 which is an on/off valve which controls (is opened/closed so as to control) a flow rate of the condensed water is disposed in the inter-unit connected condensate system 52. In addition, a high-pressure extraction steam valve 63 which is an on/off valve which controls (is opened/closed so as to control) the flow rate of the extraction steam is disposed in the high-pressure extraction steam line 43.

Then, the inter-unit connected extraction steam line 51 is branched from a section of the high-pressure extraction steam line 43 which is located between the high-pressure extraction steam valve 63 and the first feed water heater 81.

In a case where the extraction steam is supplied from the high-load unit to the low-load unit, the inter-unit connected extraction steam valve 61 is opened, the high-pressure extraction steam valve 63 of the high-load unit is opened, and the high-pressure extraction steam valve 63 of the low-load unit is closed.

That is, the steam which is exhausted from the high-pressure turbine 2 of the high-load unit is divided into steam which is supplied (distributed) to the repeater 12 of the boiler 1 of the high-load unit, steam which is supplied (distributed) to the first feed water heater 81 of the high-load unit, and steam (extraction steam) which is supplied (distributed) to the first feed water heater 81 of the low-load unit.

Accordingly, comparing a case where the extraction steam is supplied from the high-load unit to the low-load unit with a case where the extraction steam is not supplied from the high-load unit to the low-load unit, the flow rate of the steam which is supplied to the reheater 12 of the boiler 1 of the high-load unit is reduced in the former case.

On the other hand, all of the steam which is exhausted from the high-pressure turbine 2 of the low-load unit is supplied to the reheater 12 of the boiler 1 of the low-load unit.

Accordingly, comparing the case where the extraction steam is supplied from the high-load unit to the low-load unit with the case where the extraction steam is not supplied from the high-load unit to the low-load unit, the flow rate of the steam which is supplied to the reheater 12 of the boiler 1 of the low-load unit is increased in the former case.

Incidentally, the first feed water heater 81 of the low-load unit is capable of operating with a pressure of the steam (extraction steam) which is supplied to the first feed water heater 81 of the low-load unit.

The steam power plant according to the present embodiment has the first steam power plant having the boiler 1 which generates the steam, the high-pressure turbine 2 which is driven with the steam that the boiler 1 generates, the first reheat line 22 which supplies the steam which is exhausted or extracted from the high-pressure turbine 2 to the boiler 1, the first feed water heater 81 to which the part of the steam which is exhausted or extracted from the high-pressure turbine 2 is supplied, and the high-pressure extraction steam line 43 which supplies the part of the steam which is exhausted or extracted from the high-pressure turbine 2 to the first feed water heater 81 as well as the second steam power plant having the boiler 1 which generates the steam, the high-pressure turbine 2 which is driven with the steam that the boiler 1 generates, the first reheat line 22 which supplies the steam which is exhausted or extracted from the high-pressure turbine 2 to the boiler 1, the first feed water heater 81 to which the part of the steam which is exhausted or extracted from the high-pressure turbine 2 is supplied, and the high-pressure extraction steam line 43 which supplies the part of the steam which is exhausted or extracted from the high-pressure turbine 2 to the first feed water heater 81.

Then, the steam power plant also has the inter-unit connected extraction steam line 51 which connects the high-pressure extraction steam line 43 of the first steam power plant with the high-pressure extraction steam line 43 of the second steam power plant.

In addition, a modification method of the steam power plant according to the present embodiment is the modification method of the steam power plant which has the first steam power plant (the first unit) and the second steam power plant (the second unit). In a case of modifying the steam power plant, the inter-unit connected extraction steam line 51 which connects the high-pressure extraction steam line 43 of the first steam power plant with the high-pressure extraction steam line 43 of the second steam power plant is installed.

The steam power plant according to the present embodiment is of the type having the plurality of units in this way. It is possible to improve plant efficiency in partial-load operation of the plurality of units (two in the present embodiment) in total by, for example, installing the inter-unit connected extraction steam line 51 which connects the high-pressure extraction steam line 43 of the first steam power plant (the first unit) with the high-pressure extraction steam line 43 of the second steam power plant (the second unit), that is, by lending (for example, supplying the extraction steam from the high-load unit to the low-load unit) the extraction steam to each other between the first unit (for example, the high-load unit) and the second unit (for example, the low-load unit).

Next, a mechanism of a reduction in feed water temperature due to a reduction in generator output will be described.

Figure 2:
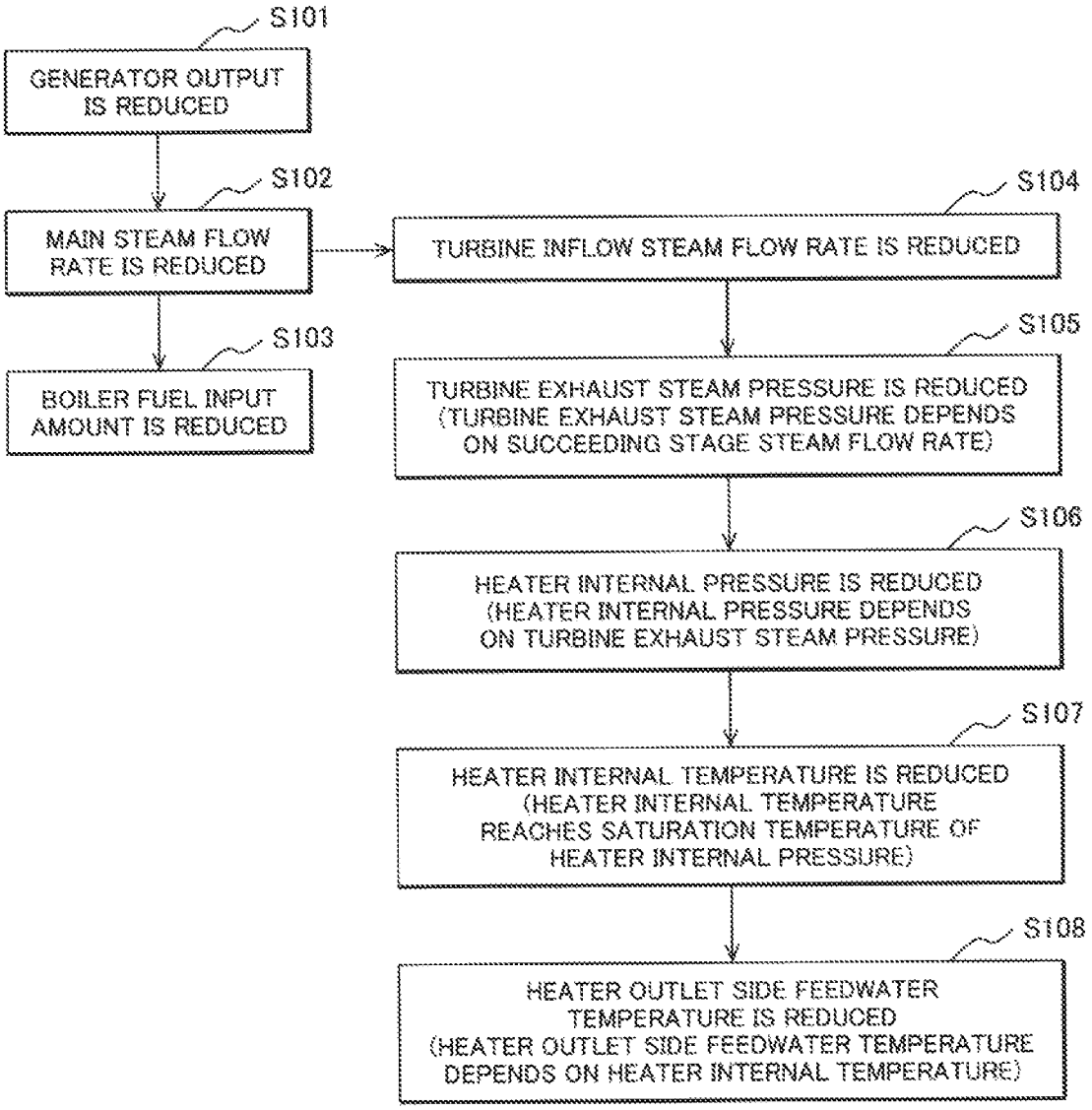
FIG. 2 is a flowchart explaining one example of a mechanism of a reduction in feed water temperature due to a reduction in generator output.

FIG. 2 is a flowchart explaining one example of the mechanism of the reduction in feed water temperature due to the reduction in generator output.

In a case where the output from the generator is reduced in the unit concerned (S101), a flow rate of main steam is reduced (S102).

In a case where the flow rate of the main steam is reduced (S102), an input amount of fuel which is input into the boiler 1 is reduced (S103).

In a case where the flow rate of the main steam is reduced (S102), a flow rate of the steam which flows into the high-pressure turbine 2 is reduced (S104).

In a case where the flow rate of the steam which flows into the high-pressure turbine 2 is reduced (S104), a pressure of the steam which is exhausted from the high-pressure turbine 2 is reduced (S105). Incidentally, the pressure of the steam which is exhausted from the high-pressure turbine 2 depends on a flow rate of the steam which is supplied to a succeeding stage.

In a case where the pressure of the steam which is exhausted from the high-pressure turbine 2 is reduced (S105), an internal pressure in the first feed water heater 81 is reduced (S106). Since the first feed water heater 81 uses the steam which is exhausted from the high-pressure turbine 2 as heating steam, the internal pressure in the first feed water heater 81 depends on the pressure of the steam which is exhausted from the high-pressure turbine 2.

In a case where the internal pressure in the first feed water heater 81 is reduced (S106), an internal temperature in the first feed water heater 81 is reduced (S107). Since heat exchange is performed between the heating steam and feed water in the first feed water heater 81 and the heating steam is condensed to saturated water, the internal temperature in the first feed water heater 81 reaches a saturation temperature for the internal pressure in the first feed water heater 81.

In a case where the internal temperature in the first feed water heater 81 is reduced (S107), a feed water temperature on the outlet side of the first feed water heater 81 is reduced (S108). The feed water temperature on the outlet side of the first feed water heater 81 depends on the internal temperature in the first feed water heater 81.

In a case where the output from the generator is reduced in this way, the feed water temperature on the outlet side of the first feed water heater 81 is also reduced.

That is, in a case where the steam power plant is operated under the partial load (a case where the output from the generator is more reduced than the output which is generated under a full load), the feed water temperature on the outlet side of the first feed water heater 81 (a final feed water temperature) is reduced and the plant efficiency is reduced.

Next, a case where the extraction steam is lent to each other (one another) between (among) a plurality of units will be described.

Figure 3:
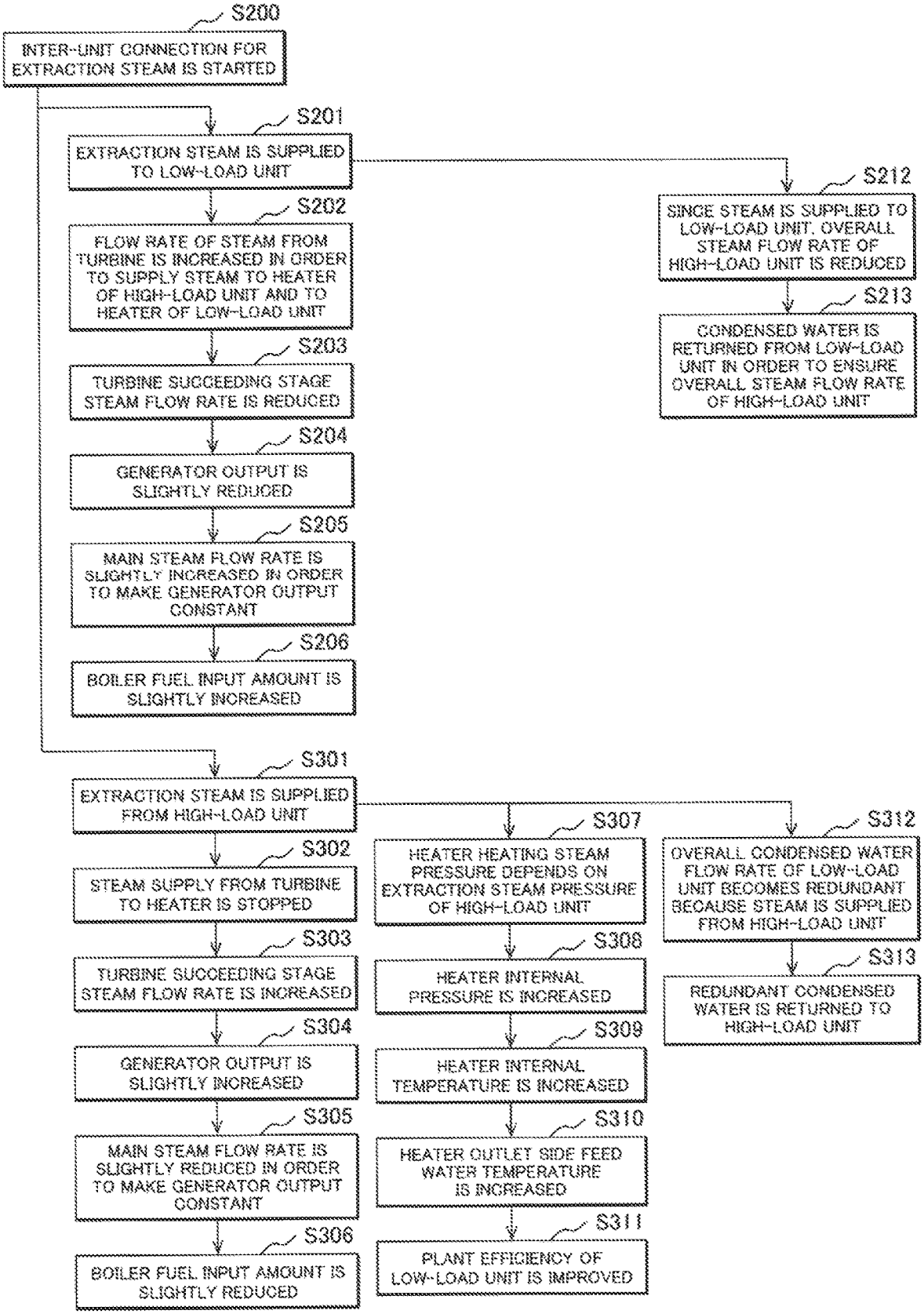
FIG. 3 is a flowchart explaining one example of a case where extraction steam is lent to each other (one another) between (among) the plurality of units.

FIG. 3 is a flowchart for explaining one example of a case where the extraction steam is lent to each other between the plurality of units.

In the case where the extraction steam is lent to each other between the plurality of units (connection for lending the extraction steam to each other between the units is started) (S200), operations are performed as follows.

The operations are performed as follows in the first unit (for example, the high-load unit).

In a case where inter-unit connection for mutually lending the extraction steam is stared (S200), the extraction steam is supplied to the second unit (for example, the low-load unit) (S201). Incidentally, a timing that loads on the first unit and the second unit become unbalanced is preferable as a timing that the inter-unit connection for mutually lending the extraction steam is started.

In a case where the extraction steam is supplied to the low-load unit (S201), the flow rate of the steam which is exhausted from the high-pressure turbine 2 is increased in order to supply the steam to the first feed water heater 81 of the high-load unit and to the first feed water heater 81 of the low-load unit (S202).

In a case where the flow rate of the steam which is extracted from the high-pressure turbine 2 to the first feed water heater 81 is increased (S202), a flow rate of the steam which is supplied to succeeding stages of the high-pressure turbine 2 is reduced (S203).

In a case where the flow rate of the steam which is supplied to the succeeding stages of the high-pressure turbine 2 is reduced (S203), the output from the generator is slightly reduced (S204).

In a case where the output from the generator is slightly reduced (S204), the flow rate of the main steam is slightly increased in order to make the output from the generator constant (S205).

In a case where the flow rate of the main steam is slightly increased (S205), the input amount of the fuel which is input into the boiler 1 is slightly increased (S206).

In a case where the extraction steam is supplied to the low-load unit (S201), since the extraction steam is supplied to the low-load unit, an overall flow rate of the steam in the high-load unit is reduced (S212).

The condensed water is returned from the low-load unit to the high-load unit in order to ensure the overall flow rate of the steam in the high-load unit (S213).

The operations are performed as follows in the second unit (for example, the low-load unit).

In a case where the connection between the units for lending the extraction steam to each other is started (S200), the extraction steam is supplied from the high-load unit to the low-load unit (S301).

In a case where the extraction steam is supplied from the high-load unit to the low-load unit (S301), supply of the steam which is exhausted from the high-pressure turbine 2 to the first feed water heater 81 is stopped (S302). Since the extraction steam is supplied from the high-load unit, the extraction steam which is supplied from the high-load unit is supplied to the first feed water heater 81 of the low-load unit. That is, the steam which is exhausted from the high-pressure turbine 2 of the low-load unit is not supplied to the first feed water heater 81 of the low-load unit.

In a case where supply of the steam which is exhausted from the high-pressure turbine 2 to the first feed water heater 81 is stopped (S302), the flow rate of the steam which is supplied to the succeeding stages of the high-pressure turbine 2 is increased (S303).

In a case where the flow rate of the steam which is supplied to the succeeding stages of the high-pressure turbine 2 is increased (S303), the output from the generator is slightly increased (S304).

In a case where the output from the generator is slightly increased (S304), the flow rate of the main steam is slightly reduced in order to make the output from the generator constant (S305).

In a case where the flow rate of the main steam is slightly reduced (S305), the input amount of the fuel which is input into the boiler 1 is slightly reduced (S306).

In a case where the extraction steam is supplied from the high-load unit to the low-load unit (S301), a pressure of heating steam which is supplied to the first feed water heater 81 depends on a pressure of the extraction steam which is supplied from the high-load unit (S307).

In a case where the pressure of the heating steam which is supplied to the first feed water heater 81 depends on the pressure of the extraction steam which is supplied from the high-load unit (S307), since the pressure of the extraction steam which is supplied from the high-load unit to the first feed water heater 81 of the low-load unit is higher than a pressure of extraction steam which is supplied from the high-pressure turbine 2 of the low-load unit to the first feed water heater 81 of the low-load unit, the internal pressure in the first feed water heater 81 is increased in the low-load unit (S308).

In a case where the internal pressure in the first feed water heater 81 is increased (S308), the internal temperature in the first feed water heater 81 is increased (S309).

In a case where the internal temperature in the first feed water heater 81 is increased (S309), the feed water temperature on the outlet side of the first feed water heater 81 is increased (S310).

In a case where the feed water temperature on the outlet side of the first feed water heater 81 is increased (S310), the plant efficiency of the low-load unit is improved (S311).

In a case where the extraction steam is supplied from the high-load unit to the low-load unit (S301), since the extraction steam is supplied from the high-load unit to the low-load unit, the overall flow rate of the condensed water of the low-load unit is increased (becomes redundant) (S312).

The redundant condensed water is returned from the low-load unit to the high-load unit (S313).

According to the present embodiment, it is possible to suppress a reduction in the final feed water temperature in the partial-load operation of the low-load unit by supplying the extraction steam from the high-load unit to the low-load unit in this way and thereby to improve the plant efficiency. Thereby, it is possible to improve the plant efficiency in the partial-load operation (a state where a high-load operation and a low-load operation are performed) of the two units in total.

Next, a calculation formula (Formula (1)) of a numerical value (a heat consumption rate (a heat rate: HR) which indicates the plant efficiency will be indicated.

(1) The heat consumption rate [kJ/kWh]={(turbine plant heat input [kJ/h])−(turbine plant heat output [kJ/h])}/generator output [kW]={(main steam heat quantity+second reheat steam heat quantity}−(final feed water heat quantity+first reheat steam heat quantity)}/generator output . . . Formula (1)

Next, for example, in a case where the extraction steam is lent to each other between the two units, a heat consumption rate of the high-load unit is indicated in Formula (2) and a heat consumption rate of the low-load unit is indicted in Formula (3) respectively.

(2) The heat consumption rate of the high-load unit={(turbine plant heat input [kJ/h])−(turbine plant heat output [kJ/h])}/generator output [kW]={(main steam heat quantity+second reheat steam heat quantity+condensed water return heat quantity from the low-load unit)−(final feed water heat quantity+first reheat steam heat quantity+heat quantity of extraction steam to the low-load unit)}/generator output . . . Formula (2)

(3) The heat consumption rate of the low-load unit={(turbine plant heat input [kJ/h])−(turbine plant heat output [kJ/h])}/generator output [kW]={(main steam heat quantity+second reheat steam heat quantity+heat quantity of extraction steam from the high-load unit)−(final feed water heat quantity+first reheat steam heat quantity+condensed water return heat quantity to the high-load unit)}/generator output . . . Formula (3)

Incidentally, in the formulae, the main steam heat quantity is the heat quantity of the steam which is generated in the super heater 11 of the boiler 1 and is supplied to the high-pressure turbine 2, the second reheat steam heat quantity is the heat quantity of the steam which is generated in the reheater 12 of the boiler 1 and is supplied to the intermediate-pressure turbine 3, the final feed water heat quantity is the heat quantity of the feed water on the outlet side of the first feed water heater 81, the first reheat steam heat quantity is the heat quantity of the steam which is exhausted from the high-pressure turbine 2 and is supplied to the reheater 12 of the boiler 1, the condensed water return heat quantity is the heat quantity of the condensed water which is returned from the low-load unit to the high-load unit, and the extraction steam heat quantity is the heat quantity of the extraction steam which is exhausted from the high-pressure turbine 2 and is supplied from the high-load unit to the low-load unit.

That is, the heat quantity of the extraction steam to the low-load unit in the formula (2) and the heat quantity of the extraction steam from the high-load unit in the formula (3) are cancelled out each other, and the condensed water return heat quantity from the low-load unit in the formula (2) and the condensed water return heat quantity to the high-load unit in the formula (3) are cancelled out each other.

In addition, the main steam heat quantity, the second reheat steam heat quantity, the first reheat steam heat quantity, and the final feed water heat quantity in the formula (2) and the main steam heat quantity, the second reheat steam heat quantity, and the first reheat steam heat quantity in the formula (3) do not greatly change in comparison with the heat quantities obtained in a case where the extraction steam is not lent to each other between the two units. On the other hand, the final feed water heat quantity in the formula (3) is greatly increased with increasing the final feed water temperature.

That is, an increment in the final feed water heat quantity in the formula (1) is exhibited as an effect of improving the plant efficiency.

Incidentally, the heat consumption rate (HR) is a numerical value which indicates "how many kW of power generation is possible by how much quantity of heat" and indicates that the smaller the numerical value is, the higher the plant efficiency is.

In addition, as indicated in the formula (1), in a case where the turbine plant input heat is constant, the smaller the turbine plant heat output is, the more the plant efficiency is worsened. Consequently, the more the final feed water temperature is reduced and the more the final feed water heat quantity is reduced, the more the plant efficiency is worsened.

Next, the heat consumption rate (HR) which is obtained in a case where the output from the generator of one unit is about 350 MW, the high-load unit is about 80% in load, and the low-load unit is about 40% in load will be described. Incidentally, the following description is merely of one model (the model which is based on a specific condition). However, a condition of a case (a case A) where the extraction steam is supplied from the high-load unit to the low-load unit and a condition of a case (a case B) where the extraction steam is not supplied from the high-load unit to the low-load unit are the same as each other.

Then, in both the case A and the case B, the total output from the generators of the high-load unit and the low-load unit is about 420 MW, and the output from the generator of the high-load unit is about 280 MW and the output from the generator of the low-load unit is about 140 W.

In the case A, HRs are as follows. HR of the high-load unit is about 7970 [kJ/kWh] and HR of the low-load unit is about 8800 [kJ/kWh]. Then, a weighted average of these values is about 8247 [kJ/kWh].

On the other hand, in the case B, HRs are as follows. HR of the high-load unit is about 8140 [kJ/kWh] and HR of the low-load unit is about 8610 [kJ/kWh]. Then, a weighted average of these values is about 8297 [kJ/kWh].

Incidentally, the weighted average is calculated in accordance with a formula (HR of the high-load unit×80%+HR of the low-load unit×40%)÷(0.8+0.4).

Thereby, the plant efficiency of the case A is improved by about 0.6% ((8247-8297)÷8297×100) in comparison with the plant efficiency of the case B.

The steam power plant according to the present embodiment makes it possible to improve the plant efficiency in the partial-load operation of the two units in total by, for example, installing the inter-unit connected extraction steam line 51 which connects the first unit with the second unit, that is, by lending the extraction steam to each other between the high-load unit and the low-load unit in this way.

Incidentally, the present invention is not limited to the abovementioned embodiment, and various modified examples are included. For example, the abovementioned embodiment is specifically described for easy understanding of the present invention and is not necessarily limited to the one having all the abovementioned configurations.

REFERENCE SIGNS LIST

1 . . . boiler, 11 . . . super heater, 12 . . . reheater, 2 . . . high-pressure turbine, 3 . . . intermediate-pressure turbine, 4 . . . low-pressure turbine, 5 . . . condenser, 6 . . . low-pressure heater, 7 . . . deaerator, 8 . . . high-pressure heater, 81 . . . first feed water heater, 82 . . . second feed water heater, 21 . . . main steam line, 22 . . . first reheat line, 23 . . . second reheat line, 24 . . . cross-over pipe, 25 . . . low-pressure steam line, 26 . . . condensate system, 27 . . . feedwater system, 31 . . . condensate extraction pump, 32 . . . boiler feed pump, 41 . . . low-pressure extraction steam line, 42 . . . intermediate-pressure extraction steam line, 43 . . . high-pressure extraction steam line, 51 . . . inter-unit connected extraction steam line, 52 . . . inter-unit connected condensate system, 61 . . . inter-unit connected extraction steam valve, 62 . . . inter-unit connected condensate valve, 63 . . . high-pressure extraction steam valve.

What is claimed is:

1. A steam power plant comprising:

a first steam power plant having a boiler which generates steam, a high-pressure turbine which is driven with the steam that the boiler generates, a first reheat line which supplies the steam which is exhausted or extracted from the high-pressure turbine to the boiler, a first feed water heater to which part of the steam which is exhausted or extracted from the high-pressure turbine is supplied, and a high-pressure extraction steam line which supplies the part of the steam which is exhausted or extracted from the high-pressure turbine to the first feed water heater;

a second steam power plant having a boiler which generates steam, a high-pressure turbine which is driven with the steam that the boiler generates, a first reheat line which supplies the steam which is exhausted or extracted from the high-pressure turbine to the boiler, a first feed water heater to which part of the steam which is exhausted or extracted from the high-pressure turbine is supplied, and a high-pressure extraction steam line which supplies the part of the steam which is exhausted or extracted from the high-pressure turbine to the first feed water heater; and an inter-unit connected extraction steam line which connects the high-pressure extraction steam line of the first steam power plant with the high-pressure extraction steam line of the second steam power plant.

2. The steam power plant according to claim 1, wherein the inter-unit connected extraction steam line has an inter-unit connected extraction steam valve which controls a flow rate of extraction steam.

3. The steam power plant according to claim 1, wherein the first steam power plant has a condenser which returns the steam to condensed water, a deaerator, and a condensate system which supplies the condensed water which is discharged from the condenser to the deaerator, the second steam power plant has a condenser which returns the steam to condensed water, a deaerator, and a condensate system which supplies the condensed water which is discharged from the condenser to the deaerator, the steam power plant further comprising:

an inter-unit connected condensate system which connects the condensate system of the first steam power plant with the condensate system of the second steam power plant.

4. The steam power plant according to claim 3, wherein the inter-unit connected condensate system has an inter-unit connected condensate valve which controls a flow rate of the condensed water.

5. The steam power plant according to claim 1, wherein the high-pressure extraction steam line has a high-pressure extraction steam valve which controls a flow rate of extraction steam.

6. A modification method of a steam power plant which has a first steam power plant having a boiler which generates steam, a high-pressure turbine which is driven with the steam that the boiler generates, a first reheat line which supplies the steam which is exhausted or extracted from the high-pressure turbine to the boiler, a first feed water heater to which part of the steam which is exhausted or extracted from the high-pressure turbine is suppled, and a high-pressure extraction steam line which supplies the part of the steam which is exhausted or extracted from the high-pressure turbine to the first feed water heater, and a second steam power plant having a boiler which generates steam, a high-pressure turbine which is driven with the steam that the boiler generates, a first reheat line which supplies the steam which is exhausted or extracted from the high-pressure turbine to the boiler, a first feed water heater to which part of the steam which is exhausted or extracted from the high-pressure turbine is supplied, and a high-pressure extraction steam line which supplies the part of the steam which is exhausted or extracted from the high-pressure turbine to the first feed water heater, the modification method comprising the step of:

installing an inter-unit connected extraction steam line which connects the high-pressure extraction steam line of the first steam power plant with the high-pressure extraction steam line of the second steam power plant.

7. The modification method of the steam power plant according to claim 6, further comprising the step of installing an inter-unit connected extraction steam valve which controls a flow rate of extraction steam in the inter-unit connected extraction steam line.

8. An operation method of a steam power plant which has a first steam power plant having a boiler which generates steam, a high-pressure turbine which is driven with the steam that the boiler generates, a first reheat line which supplies the steam which is exhausted or extracted from the high-pressure turbine to the boiler, a first feed water heater to which part of the steam which is exhausted or extracted from the high-pressure turbine is supplied, and a high-pressure extraction steam line which supplies the part of the steam which is exhausted or extracted from the high-pressure turbine to the first feed water heater, and a second steam power plant having a boiler which generates steam, a high-pressure turbine which is driven with the steam that the boiler generates, a first reheat line which supplies the steam which is exhausted or extracted from the high-pressure turbine to the boiler, a first feed water heater to which part of the steam which is exhausted or extracted from the high-pressure turbine is suppled, and a high-pressure extraction steam line which supplies the part of the steam which is exhausted or extracted from the high-pressure turbine to the first feed water heater, the operation method comprising the step of:

supplying part of the steam from the high-pressure extraction steam line of the first steam power plant to the high-pressure extraction steam line of the second steam power plant in a case of operating the first steam power plant under a high load and operating the second steam power plant under a low load.

* * * * *